US009592437B2

(12) United States Patent
Flammer

(10) Patent No.: US 9,592,437 B2
(45) Date of Patent: Mar. 14, 2017

(54) ADJUSTABLE PUTTING GREEN SYSTEM AND METHOD THEREOF

(71) Applicant: Deron, LLC, Providence, UT (US)

(72) Inventor: Jeffrey G. Flammer, Providence, UT (US)

(73) Assignee: DERON, LLC, Providence, UT (US)

( * ) Notice: Subject to any disclaimer, the term of this patent is extended or adjusted under 35 U.S.C. 154(b) by 78 days.

(21) Appl. No.: 14/020,163

(22) Filed: Sep. 6, 2013

(65) Prior Publication Data

US 2014/0073445 A1 Mar. 13, 2014

Related U.S. Application Data

(60) Provisional application No. 61/698,624, filed on Sep. 8, 2012.

(51) Int. Cl.

| | |
|---|---|
| ***A63B 69/36*** | (2006.01) |
| ***A63B 67/02*** | (2006.01) |
| ***A63B 71/06*** | (2006.01) |
| ***A63B 24/00*** | (2006.01) |

(52) U.S. Cl.

CPC ..... *A63B 69/3676* (2013.01); *A63B 24/00* (2013.01); *A63B 67/02* (2013.01); *A63B 69/3661* (2013.01); *A63B 71/0622* (2013.01); *A63B 2067/025* (2013.01); *A63B 2071/0691* (2013.01); *A63B 2225/20* (2013.01); *A63B 2225/50* (2013.01)

(58) Field of Classification Search

CPC ..... A63B 2067/025; A63B 67/02; A63B 69/3676

USPC ..... 473/160, 161, 150, 157, 162

See application file for complete search history.

(56) References Cited

U.S. PATENT DOCUMENTS

| | | | | |
|---|---|---|---|---|
| 1,612,291 | A * | 12/1926 | Jackson | A63B 67/02 14/69.5 |
| 3,522,947 | A | 8/1970 | Anderson et al. | |
| 3,595,581 | A * | 7/1971 | Anderson et al. | 473/161 |
| 3,658,343 | A * | 4/1972 | Rogers et al. | 473/161 |
| 3,690,673 | A * | 9/1972 | Occhipinti | 473/160 |
| 3,892,412 | A | 7/1975 | Koo | |
| 4,114,887 | A | 9/1978 | DelRaso | |
| 4,192,510 | A | 3/1980 | Miller | |
| 4,202,547 | A | 5/1980 | Mueller | |
| 4,211,417 | A | 7/1980 | Brown | |
| 4,343,469 | A * | 8/1982 | Kunita et al. | 473/156 |

(Continued)

*Primary Examiner* — Mark Graham
(74) *Attorney, Agent, or Firm* — David L. Stott

(57) ABSTRACT

Systems and methods to practice putting are provided. In one embodiment, the system includes a framework, actuators mounted to the framework, a control system, a computing device, and an artificial green. The control system is coupled to the actuators and controls actuation of the actuators. The computing device includes a display for viewing mapped green profiles and is configured to communicate with the control system. The artificial green includes a putting surface with a cup defined therein, wherein the artificial green is positioned over the actuators. With this arrangement, a user can select a putting region, after which, the computing device can translate and transfer the mapped data of the putting region to the controllers to actuate the actuators to, therefore, adjust the putting surface of the artificial green to correspond to the mapped green profile of an actual green.

20 Claims, 6 Drawing Sheets

(56) References Cited

U.S. PATENT DOCUMENTS

| | | | | |
|---|---|---|---|---|
| 4,978,127 | A | 12/1990 | Juel, Jr. | |
| 5,094,569 | A * | 3/1992 | Fleming | 405/258.1 |
| 5,301,947 | A * | 4/1994 | Kim | 473/153 |
| 5,303,924 | A * | 4/1994 | Kluttz et al. | 473/155 |
| 5,318,303 | A | 6/1994 | Kim | |
| 5,655,971 | A | 8/1997 | Wayne | |
| 5,855,522 | A | 1/1999 | Bevan | |
| 6,050,901 | A | 4/2000 | Davis | |
| 6,152,830 | A * | 11/2000 | Archie | 473/160 |
| 6,171,199 | B1 | 1/2001 | Cohodas et al. | |
| 6,263,279 | B1 | 7/2001 | Bianco et al. | |
| 6,322,455 | B1 * | 11/2001 | Howey | 473/168 |
| 6,338,682 | B1 | 1/2002 | Torchia et al. | |
| 6,697,820 | B1 | 2/2004 | Tarlie | |
| 6,746,338 | B1 | 6/2004 | Keaton | |
| 6,769,993 | B1 | 8/2004 | Lasalandra | |
| 6,913,541 | B2 * | 7/2005 | Chen | 473/161 |
| 7,918,743 | B2 | 4/2011 | Martens | |
| 8,616,988 | B1 * | 12/2013 | Coffman | 473/150 |
| 2005/0119063 | A1 * | 6/2005 | Tupman et al. | 473/154 |
| 2005/0197196 | A1 * | 9/2005 | Ostiguy | 473/160 |
| 2011/0192096 | A1 * | 8/2011 | Koberinski et al. | 52/126.6 |
| 2012/0184340 | A1 * | 7/2012 | Jang | A63B 67/02 463/2 |

* cited by examiner

ADJUSTABLE PUTTING GREEN SYSTEM AND METHOD THEREOF

CROSS-REFERENCE TO RELATED APPLICATIONS

The present application claims the benefit of U.S. Provisional Application No. 61/698,624, filed on Sep. 8, 2012, the disclosure of which is hereby incorporated by reference in its entirety.

TECHNICAL FIELD

The present invention relates generally to an artificial putting green and, more specifically, an adjustable artificial putting green.

BACKGROUND

Artificial greens are well known for practicing one's golf skills, and are a common fixture of homes, offices, hotels, and resorts, as well as being employed in the popular activity of "miniature golf." Typically, such practice greens have a surface covered with carpet or artificial turf and one or more holes into which the ball is putted.

Although traditional practice greens are useful to a degree, their benefits and enjoyability are limited by the fact that in most cases they are static structures which cannot be adjusted to provide added challenge or an element of variety. For example, many prior practice greens are simply long, flat surfaces, which provide no challenge above a certain level. In other cases practice greens have been made that incorporate certain obstacles, such as a small "sand trap" or "water hazard", but while they might add some challenge or entertainment value these features bear little or no resemblance to the conditions the golfer will encounter on a green on an actual course.

On actual putting greens, of course, the greatest challenge is usually provided by the uneven contour, with various slopes and breaks so that one cannot simply putt the ball straight towards the hole and expect it to go in. Rather, to make a putt with a slope and/or break, the speed by which the ball is hit is equally important as the direction of the ball. In many courses these features are intentionally designed into the greens, and it is a critical skill of a master golfer to be able to "read" these contours so as to be able to effectively compensate for them in making a successful putt. In point of fact, the slopes and contours of the greens of many major golf courses are cataloged and studied in depth by both professional and amateur players.

Accordingly, there exists a need for a practice putting green having a surface that is readily adjustable to a wide range of contours. Furthermore, there exists a need for such a putting green that permits varied and subtle contours to be formed within the overall lie of the surface. Still further, there exists a need for a practice putting green that will allow golfers to study the greens of many major golf courses.

BRIEF SUMMARY OF THE INVENTION

The present invention is directed to systems, devices and methods for a golfer to practice putting on an artificial putting green. In accordance with one embodiment of the present invention, a method is provided, including the steps of selecting a putting green profile from multiple mapped putting green profiles viewable on a display; selecting a hole position on the selected putting green profile viewable on the display; selecting a ball position relative to a defined radius from the selected hole position viewable on the display; translating mapped information relative to a putting region along the defined radius between the selected hole position and the selected ball position with a computing device and to a central controller coupled to an adjustable putting surface; and actuating actuators positioned below the adjustable putting surface and controlled by the central controller, the actuators moveable to pre-determined positions relative to the mapped information to modify the modifiable putting surface to correspond with and reflect the selected putting region of the selected putting green profile.

In one embodiment, the method step of selecting the putting green profile includes selecting the putting green profile from a remote server or database and downloading at least a portion of the selected putting green profile from the remote server or database. In another embodiment, the method step of selecting the putting green profile includes selecting the putting green profile from a local database.

In another embodiment, the method includes, prior to the selecting the putting green profile, viewing a plurality of golf course options having the mapped putting green profiles and selecting one of the golf course options. In still another embodiment, the method step of actuating the actuators includes electrically actuating the actuators mounted to a frame, each actuator vertically moveable between a first end position and a second end position.

In accordance with another embodiment of the present invention, a method for a golfer to practice putting on an artificial putting green is provided. The method includes: viewing a plurality of options relating to mapped putting green profiles on a display; selecting a putting green profile from the mapped putting green profiles on the display; viewing detail relating to the selected putting green profile: selecting a putting region on the putting green profile viewable on the display, translating mapped information relating to at least the putting region of the putting green profile with a computing device operably connected to controllers of the artificial putting green; and actuating actuators positioned below a surface of the artificial putting green with the controllers such that the actuators move to various positions to move the surface to correspond with and reflect contours of the selected putting green profile within the selected putting region.

In one embodiment, the method step of selecting the putting region includes selecting a hole position on the selected putting green profile. In another embodiment, the method step of selecting the putting region includes selecting a ball position relative to a defined radius from the selected hole position, wherein the defined radius is a length between a cup and a putting position on the artificial putting green. Further, in another embodiment, the method step of selecting the putting region includes selecting a putting area on the putting green profile that corresponds with a surface area of the artificial putting green.

In another embodiment, the method step of actuating the actuators includes actuating the actuators mounted to a frame, each actuator vertically moveable between a first end position and a second end position.

In accordance with another embodiment of the present invention, a system for a person to practice putting is provided. The system includes a framework, a plurality of actuators, an artificial green, a control system, and a computing device. The plurality of actuators are positioned on the framework in an array. Each actuator includes a motor and a shaft, the shaft including a first end and a second end, wherein the first end is coupled to the motor and rotatably moveable by the motor. The artificial green includes a putting surface with a cup defined in the surface. The artificial green is positioned over the actuators such that the second end of the shaft of each actuator is coupled to the artificial green below the putting surface. The control system is coupled to the actuators such that the control system includes multiple controllers configured to control actuation of the actuators. The computing device is coupled to the control system and is configured to communicate with the control system. Further, the computing device is coupled to a display and includes user input controls.

In another embodiment, the shaft of each actuator is threaded and rotatably coupled to a threaded sleeve, the threaded sleeve being fixedly coupled to the framework, the shaft vertically moveable through the threaded sleeve between a first end position and a second end position as the motor rotates the threaded shaft. In another embodiment, the second end of the shaft includes a coupling portion configured to couple to the artificial green below the putting surface. In still another embodiment, the second end of the shaft comprises an upper support with a flat upper surface, the flat upper surface having a larger surface area than the second end of the shaft.

In another embodiment, the plurality of actuators are configured to actuate to predetermined heights between a first end position and a second end position to provide a contoured putting surface that corresponds with a putting region taken from a putting green profile selected by a user at the display with the user input controls. In yet another embodiment, the putting region is determined by the user based on a user selected hole position and a user selected ball position selected from the putting green profile, the user selected ball position selected within a defined radius from the user selected hole position. In another embodiment, the defined radius corresponds with a length from the cup to a putting position on the putting surface of the artificial green. Further, in another embodiment, the computing device is configured to translate mapped information from the putting green profile and communicate such mapped information to the control system to control actuation of the actuators. In another embodiment, the computing device provides a user interface viewable on the display for a user to input selections particular to a putting green profile that translate to the control system to actuate the actuators to modify the putting surface to correspond with the putting green profile selected by the user.

In another embodiment, the framework is modular, the framework including at least a first framework module with a first actuator array and a second framework module with a second actuator array, each of the first actuator array and the second actuator array being controlled by the control system.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
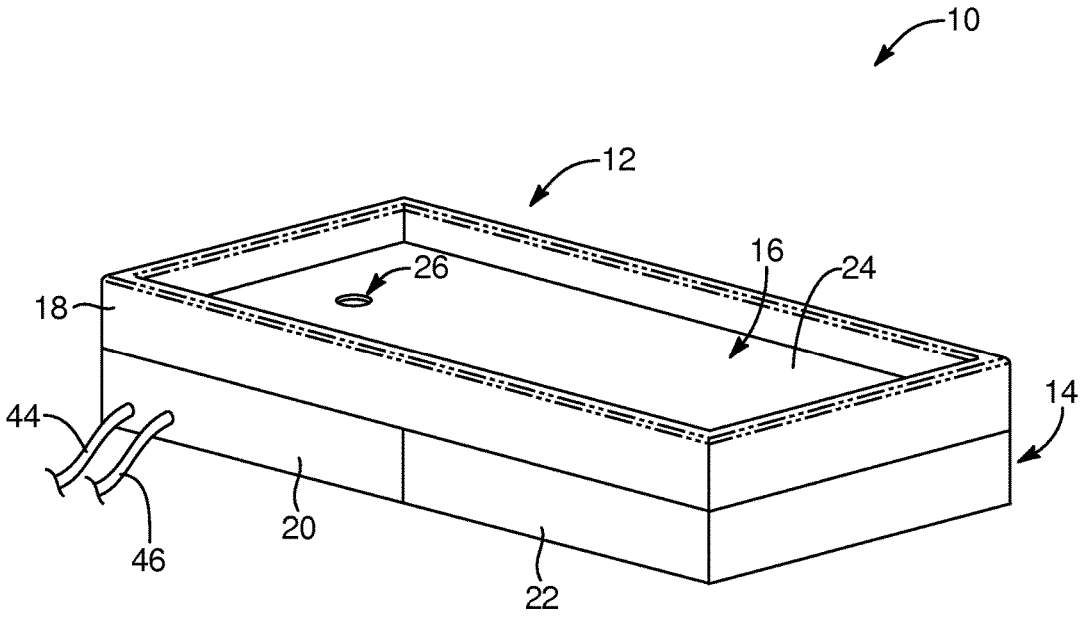
FIG. 1 is a perspective view of an adjustable putting green, according to an embodiment of the present invention.
Figure 2:
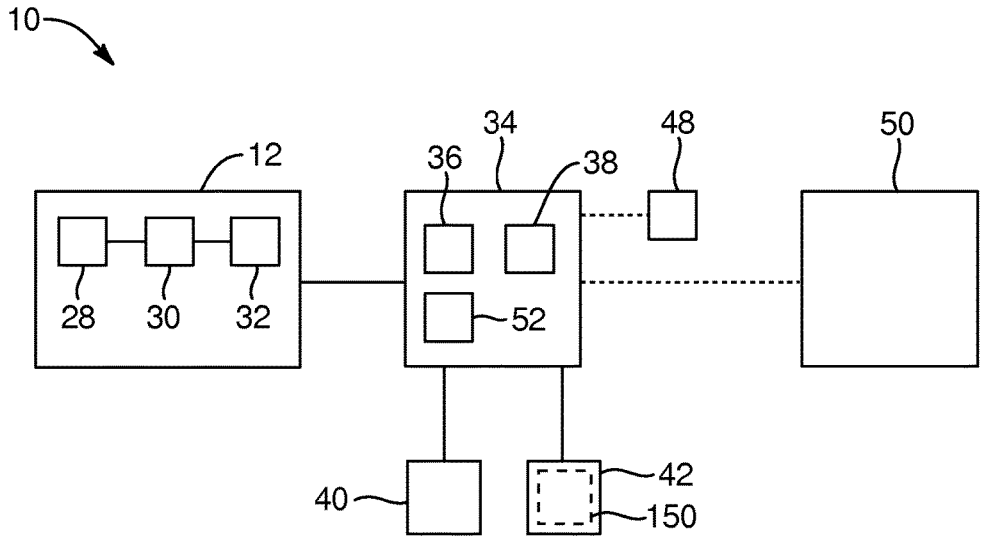
FIG. 2 is a schematic view of an adjustable putting green system, according to one embodiment of the present invention
Figure 9:
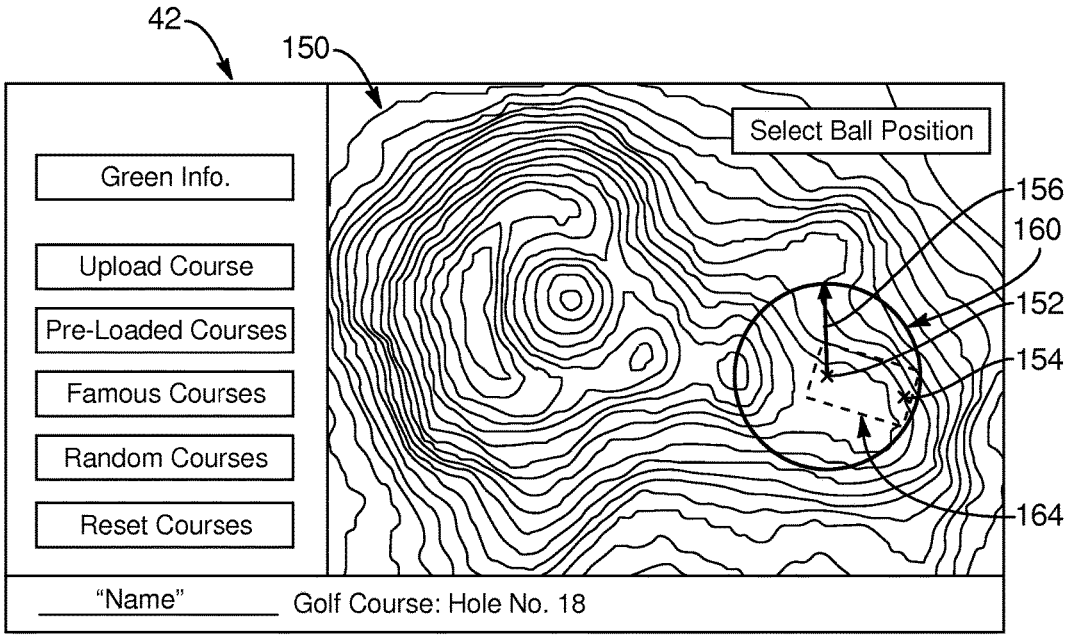
FIG. 9 is an illustrative view of a display, depicting a mapped green with a selected ball position relative to the selected hole position with an outline of a putting region, according to another embodiment of the present invention.
Figure 10:
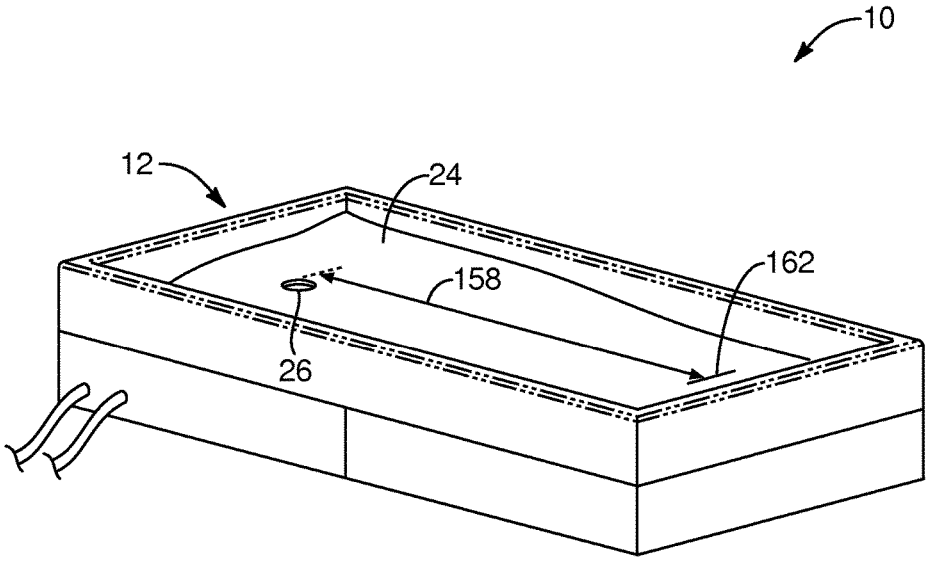
FIG. 10 is a perspective view of the adjustable putting green, depicting an adjusted putting green surface to correspond with the selected putting region of FIG. 10, according to another embodiment of the present invention.

Referring to FIGS. 1, 2, and 9, an adjustable putting green system 10 is provided. The adjustable putting green system 10 is configured to allow a user to select a mapped green profile 150, such as from mapped putting greens of well-known or random golf courses, downloaded and viewable on a computer screen or display 42. The user can then select a particular hole position 152 and ball position 154 on the mapped green profile 150 viewable on the display 42. The adjustable putting green system 10 may then translate and transfer mapped data/information to central controllers 32 and then to micro-controllers 30 and actuators 28 positioned below an artificial putting surface 24 to then adjust or modify the putting surface 24 to correspond with a putting region 164 between the selected hole and ball positions 152, 154 on the mapped green profile 150. In this manner, the adjustable putting green system 10 allows a user to adjust an artificial putting surface 24 to correspond with or reflect the actual putting surface of a selected green from a given golf course. Such golf courses may include famous or well-known golf courses, such as golf courses where the various PGA major golf championships are played, or any random golf course. Particular putting surfaces may be selected to mimic some of the greatest putts made in PGA golf championships to allow a user to practice and gauge his or her ability to play the game of golf.

Now referencing FIGS. 1 and 2, the adjustable putting green system 10 includes an adjustable putting green 12 and a computing device 34. The adjustable putting green 12 may include a framework 14, an artificial green 16, and a bank portion 18 extending upward from the framework 14 and along a perimeter of the artificial green 16. In one embodiment, the bank portion 18 may be limited in height or non-existent along the side where the user will be putting from. The framework 14 may include a modular arrangement with a plurality of modules, such as, for example, a first frame module 20 and a second frame module 22. The artificial green 16 may include a putting surface 24 with a cup 26 that extends below the putting surface 24 or, rather, inset within the artificial green 16 with a top perimeter of the cup 26 set flush or slightly below the putting surface 24.

The adjustable putting green 12 may include one or more arrays of actuators 28, micro-controllers 30, and one or more central controllers 32. Each actuator 28 may be coupled to a micro-controller 30 and each array of actuators 28 and micro-controllers 30 may be coupled to one of the central controllers 32. For example, each of the first and second frame modules 20, 22 may include one central controller 32. The one or more central controllers 32 may be coupled to the computing device 34 to receive translated mapped data of the user's selected putting region (not shown), discussed in greater detail hereafter.

The computing device 34 may include one or more processors 36, memory 38 and/or a hard-drive, user input controls 40, and a display 42. The user input controls 40 may include a key-board, mouse, or be integrated with the display 42, such as, a touch sensitive display screen or any other suitable user input controls 40. The display 42, as previously set forth, may be a computer monitor/display, a touch-screen display, or any other suitable graphical interface, such as a hand-held display that may be wirelessly coupled to the computing device 34. Further, the adjustable putting green 12 may include a power cord 44 and a controller cord 46 to couple to the computing device 34 via, for example, a USB port. Further, the computing device 34 may include various ports, such as, USB ports to facilitate accessing mapped putting greens downloaded to, for example, a memory card 48, such as a flash drive or the like. Further, the computing device 34 may communicate or be coupled to one or more remote devices 50, such as remote computing devices, servers, web sites, etc. through, for example, the Internet, for accessing mapped putting greens of various golf courses. Such may be a hard wire coupling or employ wireless technology. The computing device may also include software 52 programmed to translate the mapped data and information from a mapped putting green and then transfer such mapped data to the one or more central controllers 32 and micro-controllers 30 to control and adjust the height of each of the actuators 28, as known to one of ordinary skill in the art.

Figure 3:
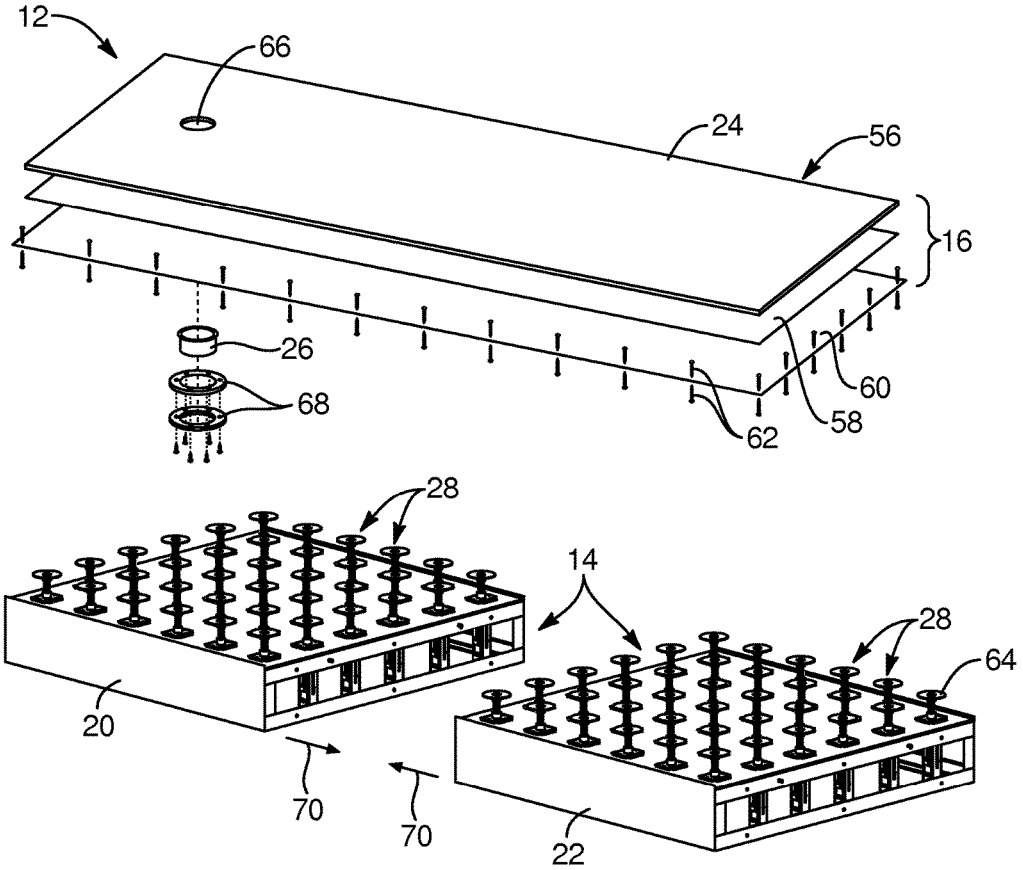
FIG. 3 is an exploded perspective view of the adjustable putting green, depicting the frame portion having a modular arrangement, according to another embodiment of the present invention.

Referring now to FIG. 3, some of the various structural components, in one embodiment, of the adjustable putting green is provided, in exploded view form. The artificial green 16 may include multiple layers positioned over the actuators 28 and the framework 14. The multiple layers may include a first layer 56, a second layer 58, and a third layer 60. The first layer 56 may include the exposed, putting surface 24, which may be an artificial turf type material. The second layer 58, or middle layer, may be a semi-rigid material, such as a Masonite layer or polymeric layer. The third layer 60, or bottom layer, may be a flexible layer and may include a weave or mesh, similar to a trampoline type material or the like. The third layer 60 may include multiple couplings 62 spaced and aligned so as to couple to an upper support 64 of each of the actuators 28. Each of the layers may include a hole 66 defined therethrough sized and configured to receive the cup 26. Such cup 26 can be reinforced and mounted to the multiple layers or framework 14 with, for example, cup mounting rings 68. Each of the layers may be coupled together with, for example, an adhesive or any other type of suitable coupling mechanism, such as sewing or any known fastening means. It should be noted that the artificial green 16 may include additional layers or less and may be made of a variety of suitable materials, as known in the art that will provide the support necessary to hold an individual standing thereon while also being somewhat flexible and able to change shape and contort via movement of the actuators 28.

As previously set forth, the framework 14 may include multiple modules. For simplistic purposes, only two frame modules are depicted, namely, the first frame module 20 and the second frame module 22. In this embodiment, the framework 14 includes a length of two frame modules and a width of a single frame module. However, the adjustable putting green 12 may include several additional frame modules to equate to the length and the width of the framework 14. For example, in one embodiment, the framework 14 of the adjustable putting green may include two, three, or four (or more) frame modules in the width and two to eight (or more) frame modules in the length, depending on the size desired for the putting surface 24. As depicted by arrows 70, the first and second frame modules 20, 22 may be secured to each other via brackets or any suitable fastening means. Similarly, additional modules may be coupled and secured together. Further, each of the first and second frame modules 20, 22 includes an array of actuators 28, each of which are mounted to the framework 14. In one embodiment, each of the frame modules may be four feet by four feet with the actuators 28 having eight inch spacing equating to thirty-six actuators per frame module. However, other embodiments for frame module sizes and spacing for the actuators may be employed, as known to one of ordinary skill in the art.

Figure 4:
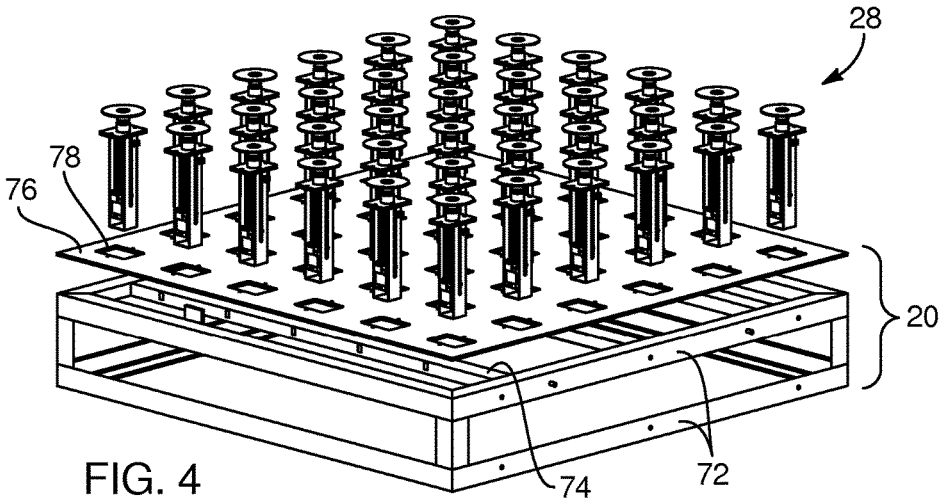
FIG. 4 is an exploded perspective view of one frame module with actuators, according to another embodiment of the present invention.

With respect to FIG. 4, a frame module, such as the first frame module 20, and its array of actuators 28 are depicted in exploded form. In one embodiment, for example, the first frame module 20 may include perimeter frame portions 72 and cross-member frame portions 74. The perimeter frame portions 72 extend and define the perimeter of the first frame module 20. The cross-member frame portions 74 may extend between opposite sides of the perimeter of the first frame module 20. The first frame module 20 may also include a frame plate 76 sized and configured to be positioned over the cross-member frame portions 74 and within the perimeter frame portions 72. The frame plate 76 may include an array of openings 78 defined therein, each opening 78 sized and configured to receive and position one of the actuators 28.

In another embodiment, rather than employing a frame plate, the actuators 28 may be mounted directly to, for example, cross-member frame portions 74. In this embodiment, each actuator 28 may be mounted directly to and between two cross-member portions 74. Further, the spacing of the actuators 28 may readily be modified since the actuators would not be consolidated within the openings of the frame plate.

Figure 5:
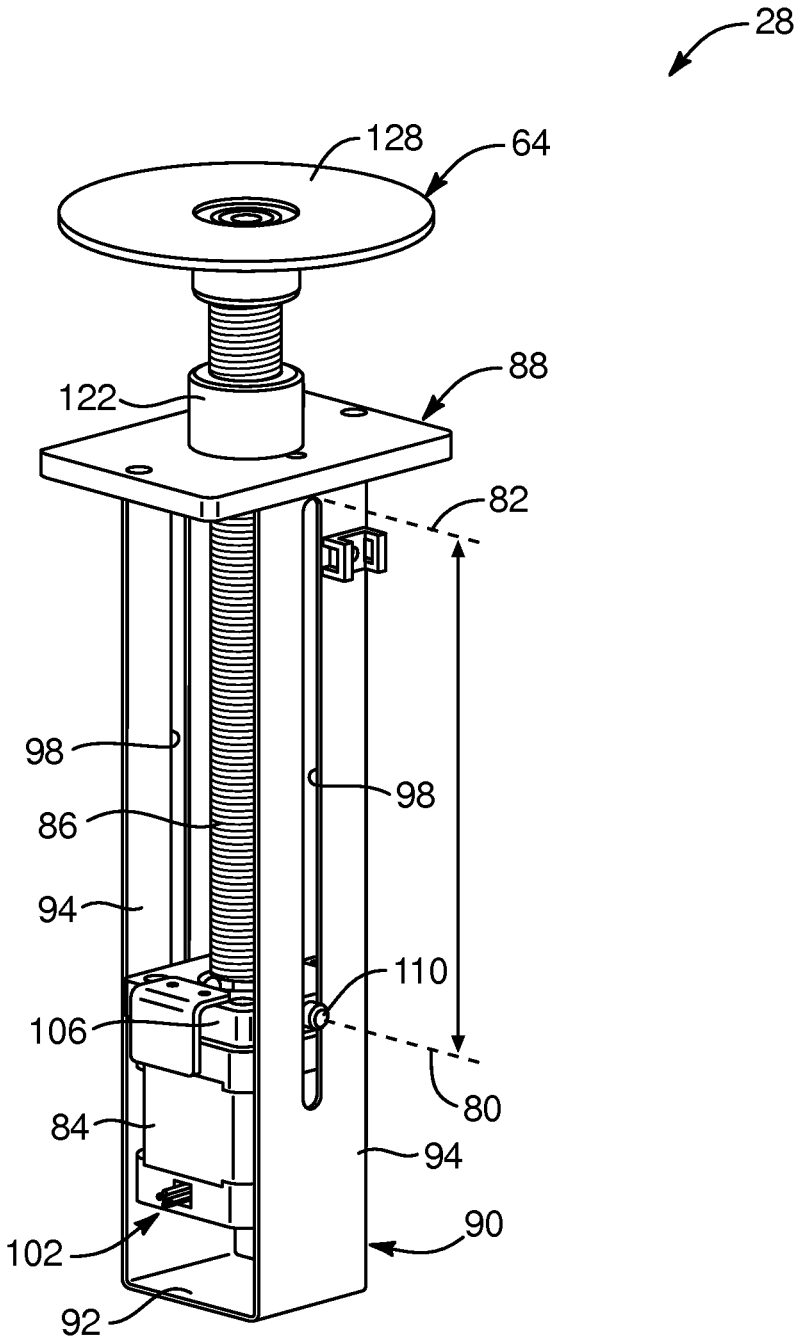
FIG. 5 is a perspective view of an actuator, according to another embodiment of the present invention.
Figure 6:
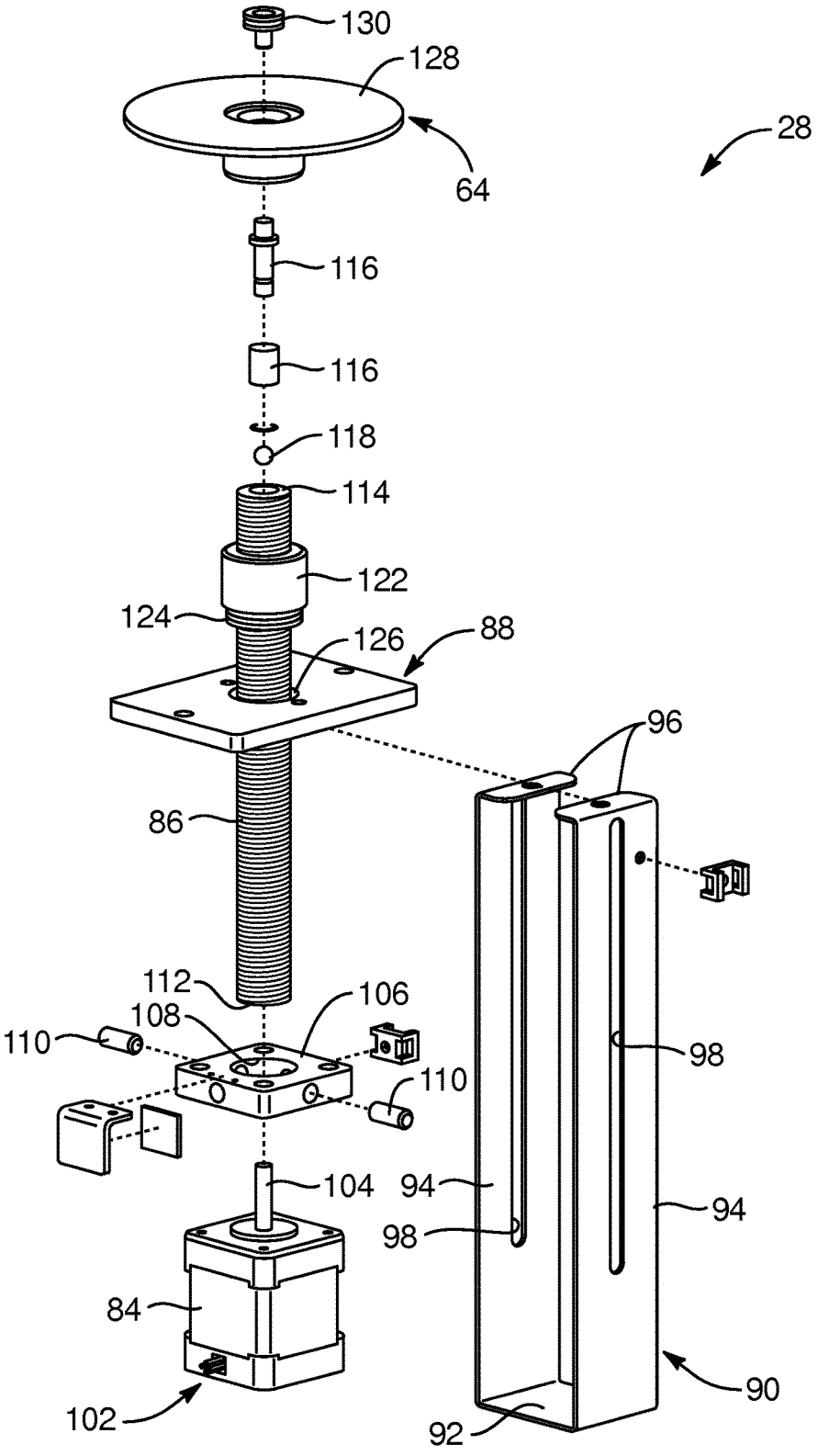
FIG. 6 is an exploded view of the actuator of FIG. 5, according to another embodiment of the present invention.
Figure 7:
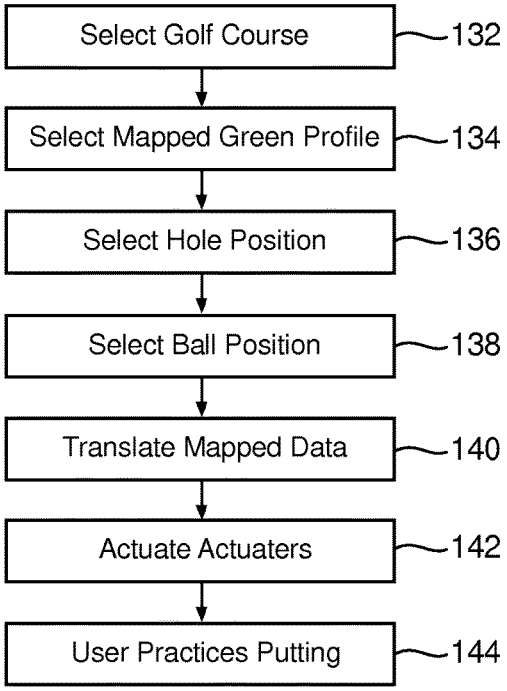
FIG. 7 is a simplified flow diagram, depicting some of the method steps employed with the adjustable putting green system, according to another embodiment of the present invention.
Figure 8:
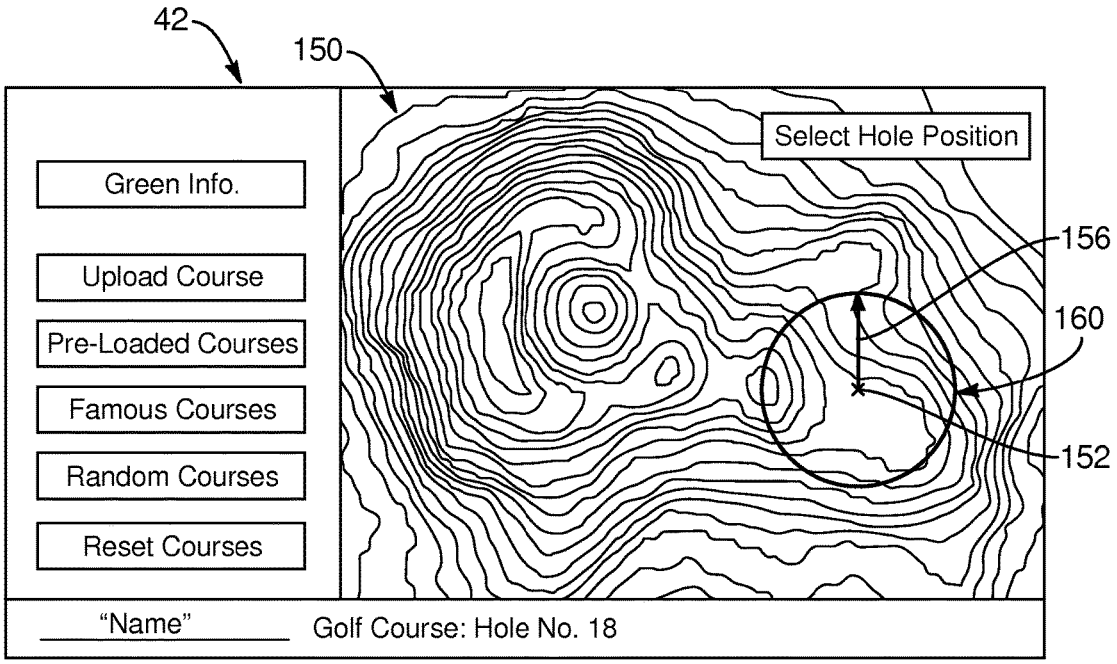
FIG. 8 is an illustrative view of a display, depicting a mapped green with a selected hole position, according to another embodiment of the present invention.

Now with reference to FIGS. 5 and 6, respective perspective and exploded views of one of the actuators 28 are provided. In one embodiment, each actuator 28 may be sized and configured to vertically move and actuate between a first end position 80 and a second end position 82. The first end position 80 is the minimal or lowest position and the second end position 82 is the maximum or highest position. Each actuator 28 may be sized and configured to actuate and stop at any pre-determined height between the first and second end positions 80, 82. In one embodiment, the actuators 28 may travel up to about twelve inches between the first and second end positions 80, 82. In another embodiment, the actuators 28 may be configured to travel up to about eighteen inches or even up to twenty-four inches. In still another embodiment where the length and width of the framework is much larger, the actuators 28 may be configured to travel up to thirty-six inches (or more).

Each actuator 28 may include a motor 84, a threaded shaft 86, a bracket 88, and an upper support 64. The actuator 28 may be sized and configured to be positioned within a motor guide 90. The motor guide 90 may include a u-shaped configuration with a lower wall 92, two upstanding walls 94 facing each other, and upper ends 96 bent inward toward each other from the two upstanding walls 94. The motor guide 90 may include vertically extending guide slots 98 defined in the two upstanding walls 94 such that the guide slots 98 may be aligned with each other. The guide slots 98 may be sized and configured to ensure the actuator 28 maintains its vertical position and vertical movement.

The motor 84 may be an electrical stepper motor coupled to a micro-controller (not shown) via wires 102, the micro-controller configured to control the height or amount of vertical travel to which the actuator 28 moves. The motor 84 includes a motor shaft 104 extending from an upper end of the motor 84. The motor shaft 104 is configured to rotate, clockwise and counter-clockwise, via the motor 84. The motor 84 may be coupled to a motor mount 106. The motor mount 106 may include a mount opening 108 sized to receive the threaded shaft 86 and be positioned over the motor shaft 104. Further the motor mount 106 may include motor mount guides 110 extending from opposite sides of the motor mount 106.

The threaded shaft 86 includes a longitudinal length extending between a first end 112 and a second end 114. The first end 112 may include a hollowed portion (not shown) defined therein sized and configured to receive the motor shaft 104 and fixed to the motor shaft 104 with, for example, a set screw (not shown). The second end 114 of the shaft 86 is coupled to the upper support 64 via sleeve couplings 116 and a ball bearing 118 arrangement, which prevents the upper support 64 from rotating while the shaft 86 rotates to different vertical positions. In addition, in another embodiment, the upper support 64 may be pivotably coupled to the second end 114 of the shaft 86 so that the upper support 64 may pivot with and against the underside slope of the artificial green (not shown). Further, the shaft 86 extends through the bracket 88 and duel threaded sleeve 122, the bracket 88 configured to be mounted to the motor guide 90 and the frame plate 76 (FIG. 4). The duel threaded sleeve 122 includes inner threads (not shown) and outer threads 124, the outer threads 124 configured to secure and fix the sleeve 122 to a threaded opening 126 defined in the bracket 88. The inner threads of the sleeve 122 configured to threadably and rotatably couple to the threaded shaft 86.

With the bracket 88 mounted to the motor guide 90, the motor mount guides 110 extend through the guide slots 98 defined in the motor guide 90 to ensure vertical stability in the actuator 28. With this arrangement, the motor 84 may rotate the motor shaft 104, which in turn rotates the threaded shaft 86. The threaded shaft 86 may then move upward or downward between the first and second end positions 80, 82, rotatably moving through the sleeve 122 with the bracket 88 and sleeve 122 arrangement held fixed to the motor guide 90 and frame plate or framework.

Further, with reference to FIGS. 3, 5, and 6, an upper surface 128 of the upper support 64 includes a surface area larger than the second end 114 of the shaft 86. Such larger surface area of the upper support 64 provides stability and distributes a given load placed upon the putting surface 24. Also, the upper support 64 may include an upper support coupling 130 configured to couple to the underside of, for example, the third layer 60 of the artificial green 16. In one embodiment, the upper support coupling 130 may be a direct coupling with a button or snap arrangement. In another embodiment, the upper support coupling 130 may be a loose coupling so as to include a flexible elastic member extending between, for example, snap couplings to the underside of the artificial green 16 and the upper support 64. In either coupling embodiment, as the shaft 86 is rotated by the motor 84 and moves to various vertical positions, the putting surface 24 also moves to a corresponding position. Each stepper motor 84 may include a torque of between about 0.98 and 2.3 kg-cm or any suitable torque output. Further, the motor 84 may rotate the shaft 86 at about 120 revolutions per minute.

Now with reference to FIGS. 7-10, one embodiment for employing the adjustable putting green system 10 will be provided. First, with respect to FIGS. 7 and 8, a user may view on the display 42 various golf courses with mapped putting greens. Once the user finds a golf course of interest, the user may select the golf course employing the user input controls, as indicated by method step 132. The user may then view on the display 42 the various mapped green profiles of the selected golf course. Such viewing may include viewing video or photographs of the actual green, viewing facts or statistics about the green, or particular famous golf puts or, for example, game winning puts of famous golfers on a given green. The user may then select a mapped green profile 150, as indicated by method step 134. A mapped green profile provides electronic data relating to the slope or the rise and run of a given green, similar to a topographical map. Once the user is satisfied with the selected mapped green profile 150, the user may then select a hole position 152 on the mapped green profile 150 viewed on the display 42 by employing the user input controls, as indicated by method step 136. The hole position 152 selected by the user may be randomly selected on the mapped green profile 150 or the user may select a pre-determined hole position based on the hole positions employed on that green in, for example, a PGA major championship or any other known event.

With respect to FIGS. 7-10, once the hole position 152 is selected, the user may select a ball position 154 on the display 42 by employing the user input controls, as indicated by method step 138. However, the ball position 154 is limited by about the length of the adjustable putting green, which translates to a radius 156 on the mapped green profile 150 shown on the display 42. In other words, the user may choose a ball position 154 anywhere within a circular area 160 defined by the radius 156, the radius 156 being about the length of the adjustable putting green or, in one embodiment, a length 158 between the cup 26 and about a putting position 162 on the adjustable putting green 12. It should also be noted that the user may choose a pre-determined ball position based on a famous putt made or not made by, for example, a PGA golfer in a golf tournament. In this manner, the user can gauge oneself relative to putts taken by professional golfers With respect to FIGS. 2, 7, 9, and 10, once the user has selected the ball position 154, the computing device 34 translates the mapped information of a putting region 164 (shown in outline form) between the selected hole position 152 and the selected ball position 154. The putting region 164 corresponds with a surface area of the putting surface 24 of the adjustable putting green 12 in relation to the selected hole and ball positions 152, 154. The mapped data/information of the putting region 164, taken from the mapped green profile 150, may then be translated by software 52 and/or programming of the computing device 34 and transferred or communicated to the central controllers 32 and the micro-controllers 30, as indicated in method step 140. Once translated and transferred to the controllers, the actuators 28 may then be actuated, as indicated by method step 142. Each of the actuators 28 are actuated to vertically move to a pre-determined height, as proscribed in the mapped data, until the actuators each are positioned to the height that contours the putting surface 24 of the adjustable putting green 12 to correspond with the actual green or mapped green profile 150 within the putting region 164. A user may then address the adjustable putting green and practice putting thereon, as indicated by method step 144.

The adjustable putting green system 10 allows a user to practice putting on a putting surface 24 that corresponds with the slopes and beaks of real putting surfaces that the user may be preparing for in an upcoming golf tournament. Further, a user can practice on the adjustable putting green system 10 to obtain the simulated experience of putting on a putting surface 24 corresponding to the greens of famous golf courses. Further, it is contemplated that a user may download, for example, the mapped green profiles 150 of the greens played by a professional golfer to, thereby, practice substantially the same putts played by the famous golfer in, for example, a major tournament. In this manner, a golfer may practice putting on the adjustable putting green system 10 to enhance his or her game and, further, compare oneself with professional golfers.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A method for a golfer to practice putting on an artificial putting green, the method comprising:

selecting a putting green profile from multiple mapped putting green profiles viewable on a display;

selecting a hole position on the selected putting green profile viewable on the display;

viewing multiple putting region options on the display only within a circular area defined by a radius from the selected hole position, the radius corresponding to about a length of the artificial putting green relative to corresponding dimensions of the selected putting green profile;

selecting a ball position within the circular area to select a putting region from the multiple putting region options, the selected putting region viewable on the display;

translating mapped information relative to the putting region defined by the selected hole position and the selected ball position with a computing device and to a central controller coupled to an adjustable putting surface of the artificial putting green, the artificial putting green having multiple layers coupled to a framework such that the multiple layers define the adjustable putting surface; and actuating an array of actuators coupled to the framework and positioned below the adjustable putting surface and controlled by the central controller, the actuators moveable to pre-determined positions relative to the mapped information to modify the adjustable putting surface to correspond with and reflect the selected putting region of the selected putting green profile, each of the actuators having a vertically extending shaft extending between a motor and an upper support coupled to an end of the shaft, each of the actuators including guide structure for guiding linear movement of the motor and the shaft to position the upper support in the predetermined positions, the shaft defining a first diameter and the upper support having an upper surface defining a second diameter, the second diameter being larger than the first diameter, the upper surface facing and directly contacting an underside of the multiple layers that define the adjustable putting surface.

2. The method according to claim 1, wherein the selecting the putting green profile comprises selecting the putting green profile from a remote server or database and downloading at least a portion of the selected putting green profile from the remote server or database.

3. The method according to claim 1, wherein the selecting the putting green profile comprises selecting the putting green profile from a local database.

4. The method according to claim 1, further comprising, prior to the selecting the putting green profile, viewing a plurality of golf course options having the mapped putting green profiles and selecting one of the golf course options.

5. The method according to claim 1, wherein the actuating the actuators comprises actuating the actuators mounted to a frame, each actuator vertically moveable between a first end position and a second end position.

6. The method according to claim 1, wherein the actuating the array of actuators comprises actuating the array of actuators such that the vertically extending shaft is threaded.

7. The method according to claim 1, wherein the actuating the array of actuators comprises actuating the array of actuators such that the upper surface is a flat surface.

8. The method according to claim 1, wherein the actuating the array of actuators comprises actuating the array of actuators such that the upper support is pivotable relative to the shaft.

9. A method for a golfer to practice putting on an artificial putting green, the method comprising:

viewing a plurality of options relating to mapped putting green profiles on a display;

selecting a putting green profile from the mapped putting green profiles on the display;

selecting a putting region from multiple putting region options relative to a user selected hole position on the putting green profile viewable on the display, the multiple putting region options only being within a circular area defined by a radius extending from the user selected hole position such that the radius corresponds to about a length of the artificial putting green relative to corresponding dimensions of the selected putting green profile;

translating mapped information relating to at least the selected putting region of the putting green profile with a computing device operably connected to one or more controllers of the artificial putting green, the artificial putting green having multiple layers coupled to a framework such that a top layer defines a putting surface; and actuating an array of actuators coupled to the framework and positioned below the multiple layers and the putting surface of the artificial putting green with the one or more controllers such that the actuators move to various positions to move the putting surface to correspond with and reflect contours of the selected putting green profile within the selected putting region, each of the actuators having a vertically extending shaft extending between a motor and an upper support coupled to an end of the shaft, each of the actuators including guide structure for guiding linear movement of the motor and the shaft to position the upper support in the predetermined positions, the shaft defining a first diameter and the upper support having an upper surface defining a second diameter, the second diameter being larger than the first diameter, the upper surface facing and directly contacting an underside of the multiple layers of the artificial putting green.

10. The method according to claim 9, wherein the selecting the putting region comprises selecting a ball position within the circular area defined by the radius and the user selected hole position.

11. The method according to claim 9, wherein the selecting the putting region comprises selecting a putting area on the putting green profile that corresponds with a surface area of the artificial putting green.

12. The method according to claim 9, wherein the actuating the actuators comprises actuating the actuators mounted to a frame, each actuator vertically moveable between a first end position and a second end position.

13. The method according to claim 9, wherein the actuating the array of actuators comprises actuating the array of actuators such that the vertically extending shaft is threaded.

14. The method according to claim 9, wherein the actuating the array of actuators comprises actuating the array of actuators such that the upper surface is a flat surface.

15. The method according to claim 9, wherein the actuating the array of actuators comprises actuating the array of actuators such that the upper support is pivotable relative to the shaft.

16. A method for a golfer to practice putting on an artificial putting green, the method comprising:

viewing a plurality of options relating to mapped putting green profiles on a display;

selecting a putting green profile from the mapped putting green profiles on the display;

selecting a putting region on the putting green profile viewable on the display;

translating mapped information relating to at least the selected putting region of the putting green profile with a computing device operably connected to one or more controllers of the artificial putting green, the artificial putting green having multiple layers coupled to a framework such that a top layer defines a putting surface; and actuating an array of actuators coupled to the framework and positioned below the multiple layers and the putting surface of the artificial putting green with the one or more controllers such that the actuators move to various positions to move the putting surface to correspond with and reflect contours of the selected putting green profile within the selected putting region, each of the actuators having a vertically extending shaft extending between a motor and an upper support coupled to an end of the shaft, each of the actuators including guide structure for guiding linear movement of the motor and the shaft to position the upper support in the predetermined positions, the shaft defining a first diameter and the upper support having an upper surface defining a second diameter, the second diameter being larger than the first diameter, the upper surface facing and directly contacting an underside of the multiple layers defining the putting surface.

17. The method according to claim 16, wherein the selecting the putting green profile comprises selecting the putting green profile from a remote server or database and downloading at least a portion of the selected putting green profile from the remote server or database.

18. The method according to claim 16, wherein the selecting the putting green profile comprises selecting the putting green profile from a local database.

19. The method according to claim 16, further comprising, prior to the selecting the putting green profile, viewing a plurality of golf course options having the mapped putting green profiles and selecting one of the golf course options.

20. The method according to claim 16, wherein the actuating the actuators comprises actuating the actuators mounted to a frame, each actuator vertically moveable between a first end position and a second end position.

* * * * *